US010273608B2

(12) United States Patent
Chiu

(10) Patent No.: US 10,273,608 B2
(45) Date of Patent: Apr. 30, 2019

(54) DUAL-LAYER MESH FABRIC

(71) Applicant: TSU YI KNITTING CO., LTD., Yunlin County (TW)

(72) Inventor: Che-Yuan Chiu, Yunlin County (TW)

(73) Assignee: TSU YI KNITTING CO., LTD., Taichung (TW)

( * ) Notice: Subject to any disclaimer, the term of this patent is extended or adjusted under 35 U.S.C. 154(b) by 521 days.

(21) Appl. No.: 15/067,136

(22) Filed: Mar. 10, 2016

(65) Prior Publication Data

US 2017/0260662 A1 Sep. 14, 2017

(51) Int. Cl.
*D04B 21/08* (2006.01)

(52) U.S. Cl.
CPC ..... *D04B 21/08* (2013.01); *D10B 2403/023* (2013.01)

(58) Field of Classification Search
CPC .. D04B 21/08; D04B 21/16; D10B 2403/011; D10B 2403/023
See application file for complete search history.

(56) References Cited

U.S. PATENT DOCUMENTS 2,073,591 A * 3/1937 Schaeffer ..... A61F 13/51 604/368
2,444,115 A * 6/1948 Reed ..... A61F 13/00008 156/88

FOREIGN PATENT DOCUMENTS

WO WO2009128493 * 10/2009

* cited by examiner

*Primary Examiner* — Cephia D Toomer
(74) *Attorney, Agent, or Firm* — Raymond Y. Chan; David and Raymond Patent Firm

(57) ABSTRACT

A dual-layer mesh fabric includes an upper gauze layer and a lower gauze layer. The upper gauze layer includes upper carded yarns. First color yarns are provided to stretch across at least two of the upper carded yarns and turned and weaved back and forth. The lower gauze layer includes lower carded yarns. Second color yarns are provided to stretch across at least two of the lower carded yarns and turned and weaved back and forth. The first and second color yarns are exchanged at a setting position, enabling the first color yarns to be tuned and inserted through the lower carded yarns and the second color yarns to be tuned and inserted through the upper carded yarns to be knitted. The upper gauze layer having the first color yarns shows the second color yarns. The lower gauze layer having the second color yarns shows the first color yarns.

2 Claims, 3 Drawing Sheets

DUAL-LAYER MESH FABRIC

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a dual-layer mesh fabric, and more particularly to a dual-layer mesh fabric able to provide a dual-color effect for each side thereof.

Description of Related Arts

A knitted mesh fabric has a better ventilation function and is widely applied to shoe vamp, underwear, leotard, and so on. This fabric is light, so it can be applied to running shoes. It benefits the runner and has become an essential future trend. According to the principle of the fabric used in textile machinery, the warps and the woofs are interlaced and weaved at right angles by a traditional shuttle loom. Due to the limitation of the shuttle loom, the color of the fabric color is monotone. There is no wide choice of colors for consumers. For the pursuit of fashion and beauty, a dual-layer mesh fabric is developed accordingly. A conventional dual-layer mesh fabric 10, as shown in FIG. 1, comprises an upper gauze layer 11 and a lower gauze layer 15. The upper gauze layer 11 is provided with a first color yarn surface 12 having small holes 13 and large holes 14. The lower gauze layer 15 corresponds to the upper gauze layer 11. The lower gauze layer 12 is provided with a second color yarn surface 16. The upper and lower gauze layers 11, 15 are sewn to form the dual-layer mesh fabric 10. The color of the first color yarn surface 12 can be seen from the upper gauze layer 11 and the color of the second color yarn surface 16 can be seen through the holes 13,14, such that the dual-layer mesh fabric 10 shows a dual color effect.

This dual-layer mesh fabric has the following shortcomings:

1. The dual-layer mesh fabric 10 must be formed with the holes 13,14 to show the color of the lower gauze layer 15. The jacquard design is subject to the holes 13, 14 to form different colors.

2. Through the holes 13,14 to show the color of the lower gauze layer 15, the shadows of the holes 13, 14 make the color dim to affect the color of the lower gauze layer 15.

3. The upper and lower gauze layers 11, 15 are separately manufactured by a single weave, and then the upper and lower gauze layers 11, 15 are sewn together by another weave. The manufacture procedure is complicated and the cost is high, so this dual-layer fabric is not practical.

Accordingly, the inventor of the present invention has devoted himself based on his many years of practical experiences to solve these problems.

SUMMARY OF THE PRESENT INVENTION

The primary object of the present invention is to solve the foregoing problems and provide a dual-layer mesh fabric composed of an upper gauze layer and a lower gauze layer. The upper gauze layer includes upper carded yarns. First color yarns are provided to stretch across at least two of the upper carded yarns and turned and weaved back and forth. The lower gauze layer includes lower carded yarns. Second color yarns are provided to stretch across at least two of the lower carded yarns and turned and weaved back and forth. The first and second color yarns are exchanged at a setting position, enabling the first color yarns to be tuned and inserted through the lower carded yarns and the second color yarns to be tuned and inserted through the upper carded yarns to be knitted. The upper gauze layer having the first color yarns shows the second color yarns. The lower gauze layer having the second color yarns shows the first color yarns. The first color yarns and the second color yarns are in different colors or made of different materials, so that both sides of the dual-layer mesh fabric have different colors. The manufacture procedure of the dual-layer mesh fabric is simplified to lower the cost.

DETAILED DESCRIPTION OF THE PREFERRED EMBODIMENT

Embodiments of the present invention will now be described, by way of example only, with reference to the accompanying drawings.

Figure 1:
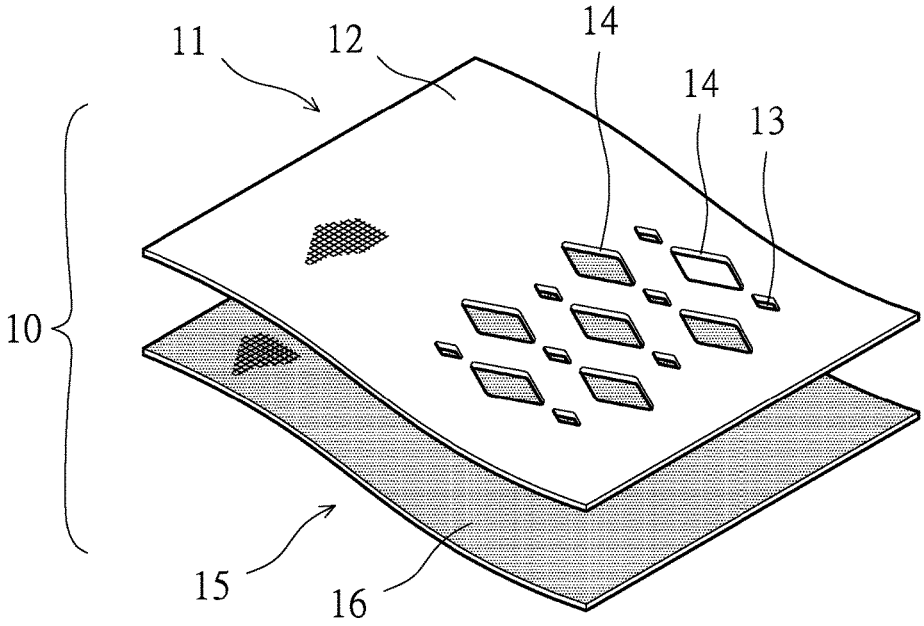
PRIOR ART FIG.1
FIG. 1 is an exploded view of the prior art.
Figure 2:
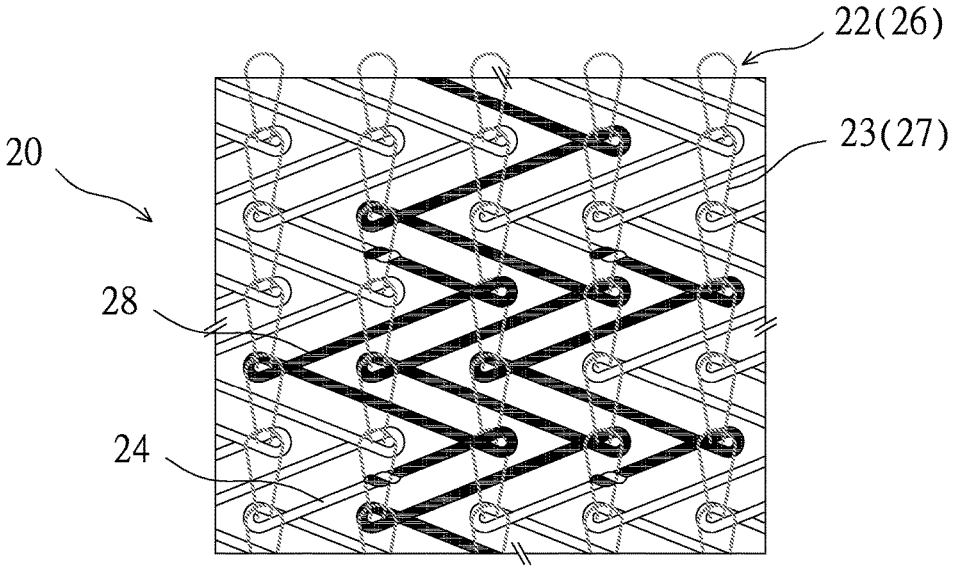
FIG. 2 is a plane view of the present invention.
Figure 3:
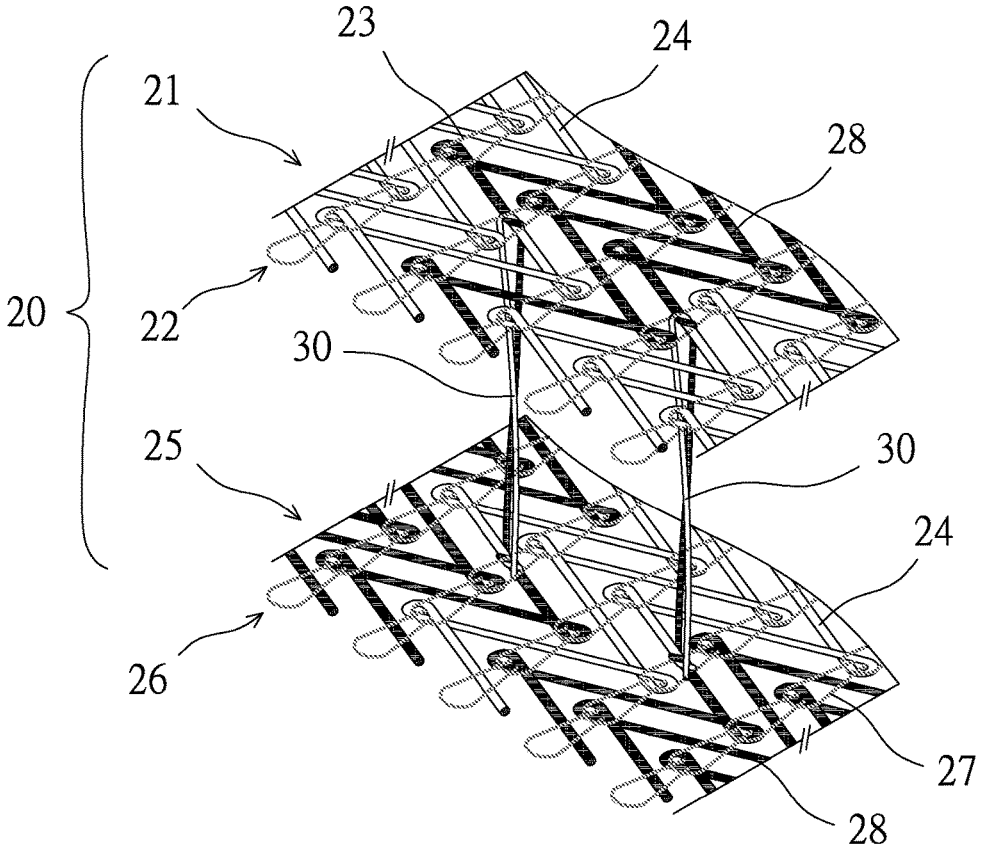
FIG. 3 is a partial perspective view of the present invention.

As shown in FIG. 2 and FIG. 3, the present invention discloses a dual-layer mesh fabric. The dual-layer mesh fabric comprises an upper gauze layer 21 and a lower gauze layer 25. Wherein, the upper gauze layer 21 comprises a plurality of upper carded yarns 22 arranged in a same direction. The upper carded yarns 22 are formed with continuous connected upper yarn loops 23 knitted by a knitting machine. Between the upper carded yarns 22 is provided with a plurality of first color yarns 24 arranged in parallel. The first color yarns 24 stretch across at least two of the upper carded yarns 22 and are turned and inserted through the upper yarn loops 23 of the upper carded yarns 22 back and forth. The lower gauze layer 25 comprises a plurality of lower carded yarns 26 arranged in the same direction. The lower carded yarns 26 are formed with continuous connected lower yarn loops 27 knitted by a knitting machine. Between the lower carded yarns 26 is provided with a plurality of second color yarns 28 arranged in parallel. The second color yarns 28 stretch across at least two of the lower carded yarns 26 and are turned and inserted through the lower yarn loops 27 of the lower carded yarns 26 back and forth. The upper gauze layer 21 selectively has at least one first setting position. The lower gauze layer 25 selectively has at least one second setting position. The second setting position corresponds to the first setting position. At the first setting position of the upper gauze layer 21, the knitting machine is deflected for guiding the yarns to be exchanged and weaved. The first color yarns 24 are turned to the second setting position of the lower gauze layer 25, enabling the first color yarns 24 to be turned and succeed the second color yarns 28 to stretch across at least two of the lower carded yarns 26 and to be turned and inserted through the lower yarn loops 27 of the lower carded yarns 26 back and forth. In the meanwhile, at the second setting position of the lower gauze layer 25, the knitting machine is deflected for guiding the yarns to be exchanged and weaved. The second color yarns 28 are turned to the first setting position of the upper gauze layer 21, enabling the second color yarns 28 to be turned and succeed the first color yarns 24 to stretch across at least two of the upper carded yarns 22 and to be turned and inserted through the upper yarn loops 23 of the upper carded yarns 22 back and forth. The first color yarns 24 and the second color yarns 28 of the upper gauze layer 21 and the lower gauze layer 25 are formed with a connecting section 30 at the turning position. The first color yarns 24 and the second color yarns 28 are overlapped at the connecting section 30, such that the upper and lower gauze layers 21, 25 are connected tightly. Accordingly, the upper gauze layer 21 having the first color yarns 25 is able to show the second color yarns 28 to constitute various jacquard designs, providing a dual-color effect.

The assembly, function and details are described hereinafter. Referring to FIG. 2 and FIG. 3, a dual-layer mesh fabric 20 is weaved by a dual needle bed tricot machine. The dual needle bed tricot machine comprises a front needle bed and a rear needle bed. The front and rear needle beds have yarn guide bars, such as ground guide bars, jacquard guide bars. The ground guide bars of the front and rear needle beds are to perform loop design. The upper carded yarns 22 and the lower carded yarns 26 are looped to form the continuous connected upper and lower yarn loops 23, 27. The jacquard guide bars are inserted through first color yarns 24 and the second color yarns 28 which are in different colors or made of different materials to perform a yarn guide program design of a transverse deflection. The first color yarns 24 stretch across the upper carded yarns 22 and are turned and inserted through the upper yarn loops 23 for hook knitting so as to form the upper gauze layer 21. The second color yarns 28 stretch across the lower carded yarns 26 and are turned and inserted through the lower yarn loops 27 for hook knitting so as to form the lower gauze layer 25. For the dual-layer mesh fabric 20 to have an area of different colors, the jacquard guide bars of the first color yarns 24 and the second color yarns 28 are deflected for guiding the yarns to be exchanged and weaved, such that the first color yarns 24 can be weaved on the surface of the lower gauze layer 25 and the second color yarns 28 can be weaved on the surface of the upper gauze layer 21. Thus, during the procedure of a single weave, the upper gauze layer 21 of the dual-layer mesh fabric 20 can show the second color yarns 28 in a different color or made of a different material, and the lower gauze layer 25 can show the first color yarns 24 in a different color or made of a different material. Through a computer software program to control the dual needle bed tricot machine, the upper gauze layer 21 is formed with various jacquard designs and patterns by means of the second color yarns 28 and the lower gauze layer 25 is formed with various jacquard designs and patterns by means of the first color yarns 24. The jacquard designs can be totems, brand logos, animals, plants, anime characters, and the like. One side of the dual-layer mesh fabric 20 can be in different colors. The manufacture procedure of the dual-layer mesh fabric 20 is simplified to lower the cost.

As the aforesaid, the upper carded yarns 22 and the lower carded yarns 26 can be transparent synthetic polyester yarns or nylon yarns, which won't affect the color effect of the first color yarns 24 and the second color yarns 28. The upper carded yarns 22 and the lower carded yarns 26 may be colored to provide a mixed color effect with the first color yarns 24 and the second color yarns 28. The first color yarns 24 and the second color yarns 28 are in different colors or made of different materials, so that both sides of the dual-layer mesh fabric 20 have complementary bright colors. The present invention is beautiful and practical.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual-layer mesh fabric, comprising an upper gauze layer and a lower gauze layer, the upper gauze layer comprising a plurality of upper carded yarns arranged in a same direction, the plurality of upper carded yarns being formed with continuous connected upper yarn loops, between the plurality of upper carded yarns being provided with a plurality of first color yarns arranged in parallel, the plurality of first color yarns stretching across at least two of the plurality of upper carded yarns and being turned and inserted through the upper yarn loops of the plurality of upper carded yarns back and forth, the lower gauze layer comprising a plurality of lower carded yarns arranged in the same direction, the lower carded yarns being formed with continuous connected lower yarn loops, between the lower carded yarns being provided with a plurality of second color yarns arranged in parallel, the plurality of second color yarns stretching across at least two of the plurality of lower carded yarns and being turned and inserted through the lower yarn loops of the plurality of lower carded yarns back and forth, the upper gauze layer having at least one first setting position, the lower gauze layer having at least one second setting position, the second setting position being corresponding to the first setting position, the plurality of first color yarns being turned at the first setting position of the upper gauze layer to the second setting position of the lower gauze layer for succeeding the plurality of second color yarns to be inserted through the lower yarn loops of the plurality of lower carded yarns, the plurality of second color yarns being turned at the second setting position of the lower gauze layer to the first setting position of the upper gauze layer for succeeding the plurality of first color yarns to be inserted through the upper yarn loops of the plurality of upper carded yarns, between the upper gauze layer and the lower gauze layer being formed with a connecting section at a position that the plurality of first color yarns and the plurality of second color yarns are exchanged, wherein the upper gauze layer has the plurality of first color yarns showing the plurality of second color yarns.

2. A dual-layer mesh fabric, comprising an upper gauze layer and a lower gauze layer, the upper gauze layer comprising a plurality of upper carded yarns arranged in a same direction, the plurality of upper carded yarns being formed with continuous connected upper yarn loops, between the plurality of upper carded yarns being provided with a plurality of first color yarns arranged in parallel, the plurality of first color yarns stretching across at least two of the plurality of upper carded yarns and being turned and inserted through the upper yarn loops of the plurality of upper carded yarns back and forth, the lower gauze layer comprising a plurality of lower carded yarns arranged in the same direction, the lower carded yarns being formed with continuous connected lower yarn loops, between the lower carded yarns being provided with a plurality of second color yarns arranged in parallel, the plurality of second color yarns stretching across at least two of the plurality of lower carded yarns and being turned and inserted through the lower yarn loops of the plurality of lower carded yarns back and forth, the upper gauze layer having at least one first setting position, the lower gauze layer having at least one second setting position, the second setting position being corresponding to the first setting position, the plurality of first color yarns being turned at the first setting position of the upper gauze layer to the second setting position of the lower gauze layer for succeeding the plurality of second color yarns to be inserted through the lower yarn loops of the plurality of lower carded yarns, the plurality of second color yarns being turned at the second setting position of the lower gauze layer to the first setting position of the upper gauze layer for succeeding the plurality of first color yarns to be inserted through the upper yarn loops of the plurality of upper carded yarns, between the upper gauze layer and the lower gauze layer being formed with a connecting section at a position that the plurality of first color yarns and the plurality of second color yarns are exchanged, wherein the lower gauze layer has the plurality of second color yarns showing the plurality of first color yarns.

* * * * *